US006981538B2

(12) United States Patent
English

(10) Patent No.: US 6,981,538 B2
(45) Date of Patent: Jan. 3, 2006

(54) POSITIONAL CONTROL DEVICE FOR SECTIONAL DOORS

(76) Inventor: William English, R.R. #1, 7864 Leslie Road East, Moffat, Ontario (CA) L0P 1J0

( * ) Notice: Subject to any disclaimer, the term of this patent is extended or adjusted under 35 U.S.C. 154(b) by 0 days.

(21) Appl. No.: 10/231,489

(22) Filed: Aug. 30, 2002

(65) Prior Publication Data

US 2003/0057712 A1 Mar. 27, 2003

Related U.S. Application Data

(60) Provisional application No. 60/315,932, filed on Aug. 31, 2001.

(51) Int. Cl.
*E05F 15/20* (2006.01)

(52) U.S. Cl. ..... 160/7; 292/195; 292/280; 292/216; 292/DIG. 36; 160/9; 160/133; 160/189; 160/201

(58) Field of Classification Search ..... 292/216, 292/DIG. 36, DIG. 46, 116, 117, 195, DIG. 61, 292/280; 160/189, 201, 133, 9; 16/198, 16/201; 403/104, 105, 107; 49/197, 199, 49/200; 264/29.1, 29.6, 29.7, 42; 423/445, 423/448

See application file for complete search history.

(56) References Cited

U.S. PATENT DOCUMENTS 983,663 A * 2/1911 White ..... 160/3
1,186,865 A * 6/1916 Uttz ..... 280/749
1,272,347 A * 7/1918 Brunst ..... 160/7
1,547,210 A * 7/1925 Garrett ..... 292/201
1,558,193 A * 10/1925 Lucking ..... 292/201
1,585,733 A * 5/1926 Perkins ..... 160/3
1,827,433 A * 10/1931 Kendall ..... 160/189
1,994,142 A * 3/1935 Madsen ..... 160/190
2,097,242 A * 10/1937 Robinson ..... 160/191
2,628,117 A * 2/1953 Robinson ..... 292/336.3
3,129,040 A * 4/1964 De Rose ..... 312/297
3,672,492 A * 6/1972 Sherr ..... 206/321
3,699,608 A * 10/1972 Schwarz ..... 16/79
4,583,706 A * 4/1986 Whitehouse et al. ..... 248/251
5,253,693 A * 10/1993 Marlatt et al. ..... 160/7
5,482,103 A * 1/1996 Burgess et al. ..... 160/9
5,690,317 A * 11/1997 Sandsborg ..... 256/1
6,029,735 A * 2/2000 Nicholson ..... 160/321
6,253,824 B1 * 7/2001 Mullet et al. ..... 160/188
6,328,354 B1 * 12/2001 Dejean et al. ..... 292/216
6,401,792 B1 * 6/2002 Mullet et al. ..... 160/188
6,485,068 B1 * 11/2002 Sauve ..... 292/171
6,527,037 B2 * 3/2003 Daus et al. ..... 160/315

* cited by examiner

*Primary Examiner*—Brian E. Glessner
*Assistant Examiner*—Carlos Lugo

(57) ABSTRACT

A positional control device is provided to prevent accidental drifting of an overhead sectional door upward or downward from a fully opened, partly opened or fully closed position. The device allows the door to be manually moved to a different elevation without requiring a separate operation to release the door from its original position. This is achieved by a mechanism which couples the upward and downward motion of the door to the rotation of a sprocket wheel engaged with a spring loaded ratchet arm with a bifurcated head specially shaped for ratcheting engagement with the teeth of the sprocket wheel. Suitable adjustment of the spring allows the ratchet mechanism to hold the door in its given position by exerting a force which can readily be overcome by manual raising or lowering the door to a different position.

10 Claims, 4 Drawing Sheets

POSITIONAL CONTROL DEVICE FOR SECTIONAL DOORS

RELATED APPLICATION

This application replaces Provisional Application No. 60/315,932 filed on Aug. 31, 2001 and entitled POSITIONAL CONTROL DEVICE FOR SECTIONAL DOORS.

FIELD OF THE INVENTION

The present invention relates to a mechanism for temporarily holding a sectional overhead door at any desired position between its fully opened and fully closed positions.

BACKGROUND OF THE INVENTION

Vertically movable sectional doors, such as those used in warehouses and other industrial settings typically employ spring, pulley and cable assemblies to counterbalance the weight of the overhead door in its motion along roller tracks.

Any imbalance which arises, e.g. through aging of the component springs of the door mechanism can result in an undesired and unpredictable tendency of the overhead door to "coast" or "drift". This can have costly and dangerous consequences, for example, in the event of a downward drifting of an opened sectional door as a forklift truck is backing up through the opening.

A number of systems have been devised to eliminate door drift, typically making use locking devices that are mechanically or electrically switchable between on and off positions. Examples are afforded by the drop-catch mechanism for vertically movable doors disclosed in U.S. Pat. No. 6,042,158 (Horn) and the locking system for sectional doors disclosed in U.S. Pat. No. 6,145,570 (Mullet et al).

None of these systems, however, allows one to manually raise or lower the door in the usual way to a selected position and then leave the door there, with confidence that it will not drift up or down from that selected position.

SUMMARY OF THE INVENTION

It is a principal object of the present invention to provide a mechanism to prevent undesirable drifting of an overhead door upward or downward from fully opened, partly opened or fully closed positions, yet allowing the door to be manually moved to a different position without the need for any separate operation to release the door from its starting position.

With a view to achieving this object, I have designed a mechanism which couples the upward and downward motion of the door to the rotation of a sprocket wheel. When the sprocket wheel is at rest, any tendency of the door to drift is resisted by a spring-loaded ratchet arm engaging the teeth of the sprocket. By proper setting of the loading spring, the force exerted by the ratchet mechanism to hold the door in its given position is readily overcome by manually raising or lowering the door to a different position, thereby rotating the sprocket wheel to a new position in which the ratchet arm again exerts sufficient engagement force with the sprocket to prevent drifting of the door.

Other objects, features and advantages of the present invention will become apparent on reading the detailed description which follows of a preferred embodiment of the invention in conjunction with the accompanying drawings, in which.

DETAILED DESCRIPTION OF PREFERRED EMBODIMENT

Figure 1:
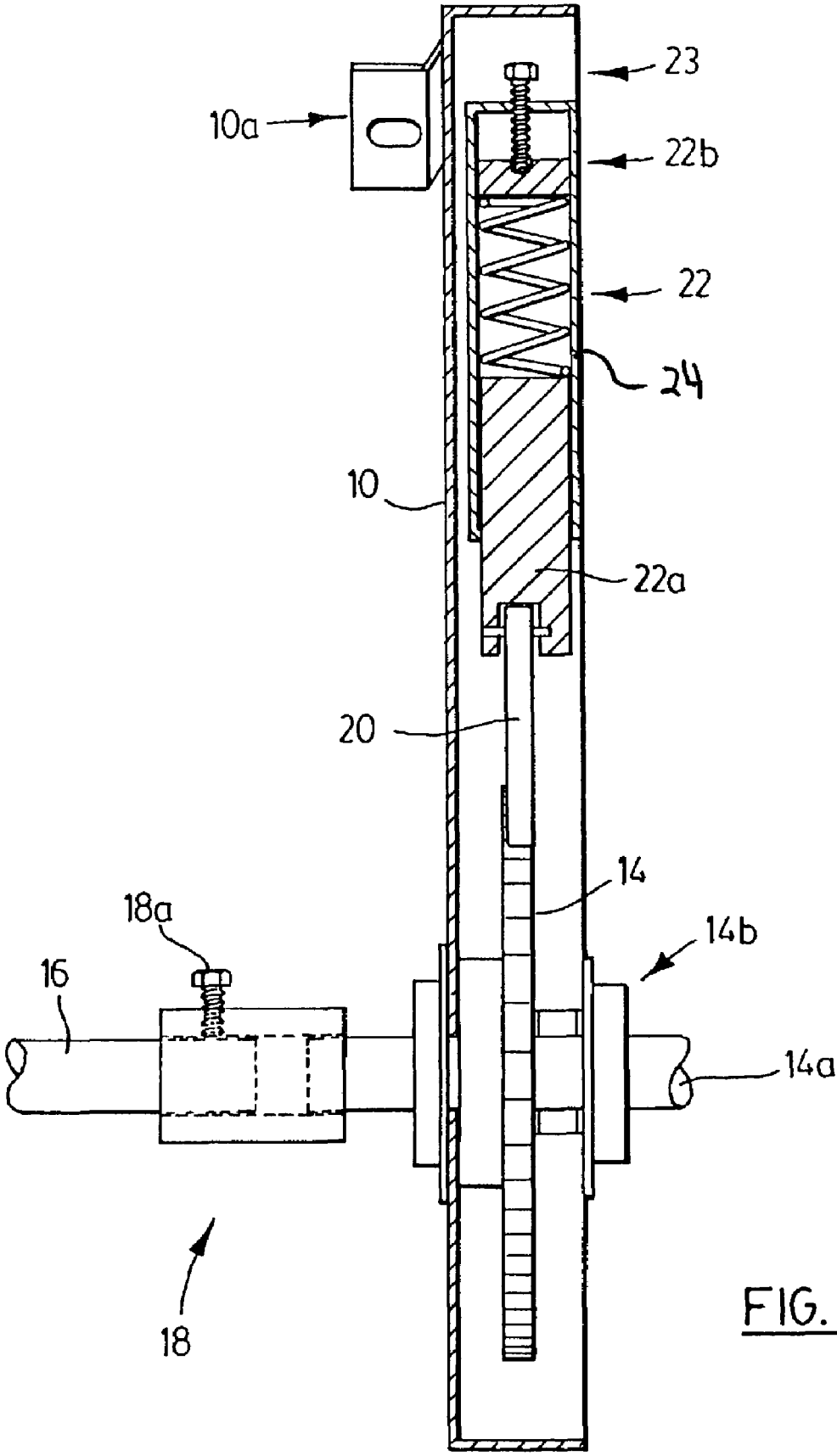
FIG. 1 is a schematic vertical sectional view of the mechanism according to the invention, seen in the direction facing the plane of a door on which the device is installed.

Referring to the drawing figures, the housing 10 for the apparatus is fixedly mounted in position to a wall adjacent to the parallel roller tracks of the overhead door by mounting clip 10*a*.

Apparatus according to the present invention may be used in association with any of a number of different kinds of torsion spring counterbalance systems for sectional doors. A typical such counterbalance system is exemplified in U.S. Pat. No. 5,419,010 (Mullet), incorporated herein by reference for its teaching on counterbalancing systems for sectional doors. The positional control device of the present invention is mechanically coupled to the sectional door counterbalance system at the system's horizontal spring shaft (drive tube) which rotates about its horizontal axis clockwise/counterclockwise with the raising/lowering of the door.

Vertical motion of the door along its tracks is accompanied by the rotational motion of the roller chain sprocket 14 having a central drive shaft 14*a* which is linearly coupled to the existing conventional door spring shaft 16 by a collar 18 and set screw 18*a*. A bearing or bushing 14*b* holds drive shaft 14*a* in secure alignment with sprocket wheel 14.

Figure 3:
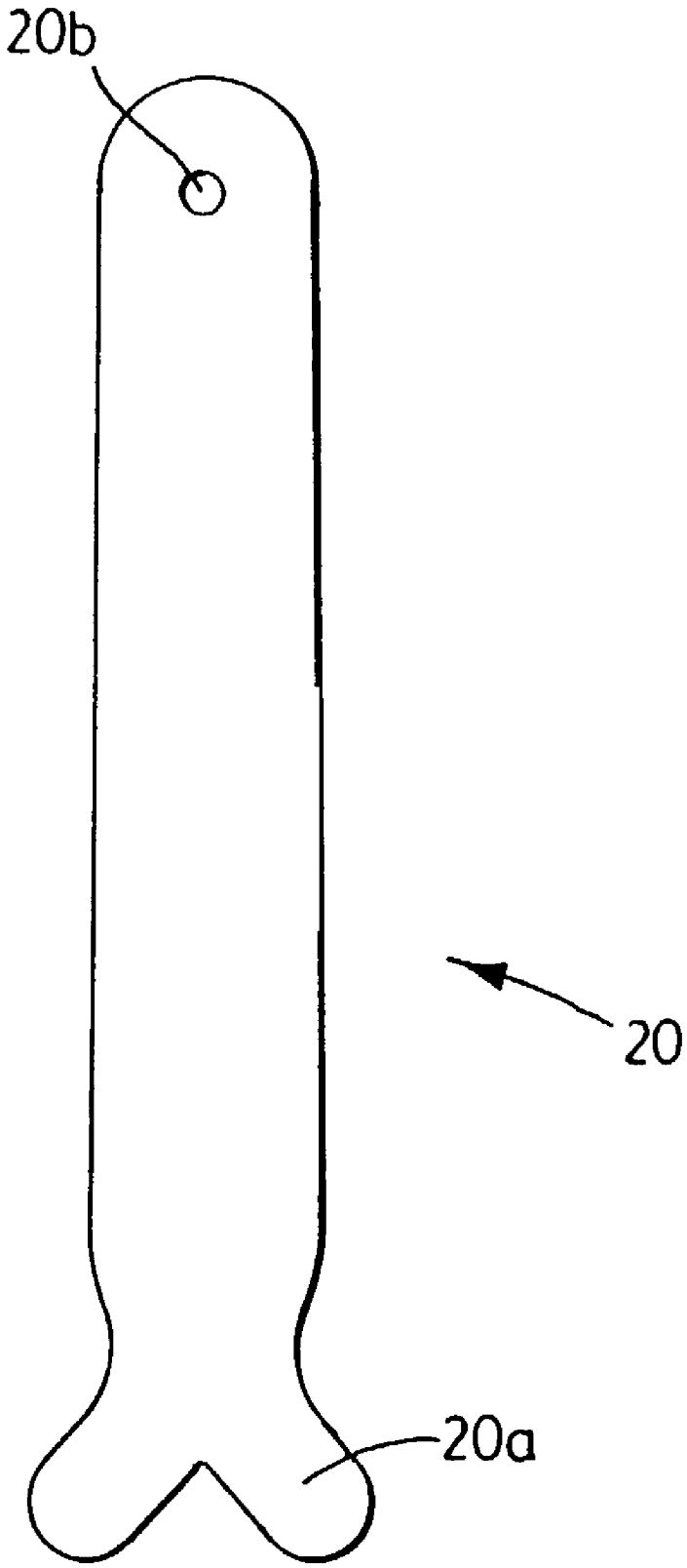
FIG. 3 is an isolated schematic drawing of the pendulum ratchet arm of the device according to the illustrated embodiment of the invention.

A pendulum ratchet arm 20 having a specially shaped, bifurcated head 20*a*, best seen in FIG. 3, is pivotally mounted at its tail end 20*b* to spring tensioning means comprising a compression spring 22 interposed between a pendulum ram 22*a* and vertically adjustable spring block 22*b* coupled to adjusting screw 23. Slide channel 24 holds spring 22 against the top end of pendulum arm 22*a* and restricts the arm 22*a* to linear motion within the channel.

Figure 2:
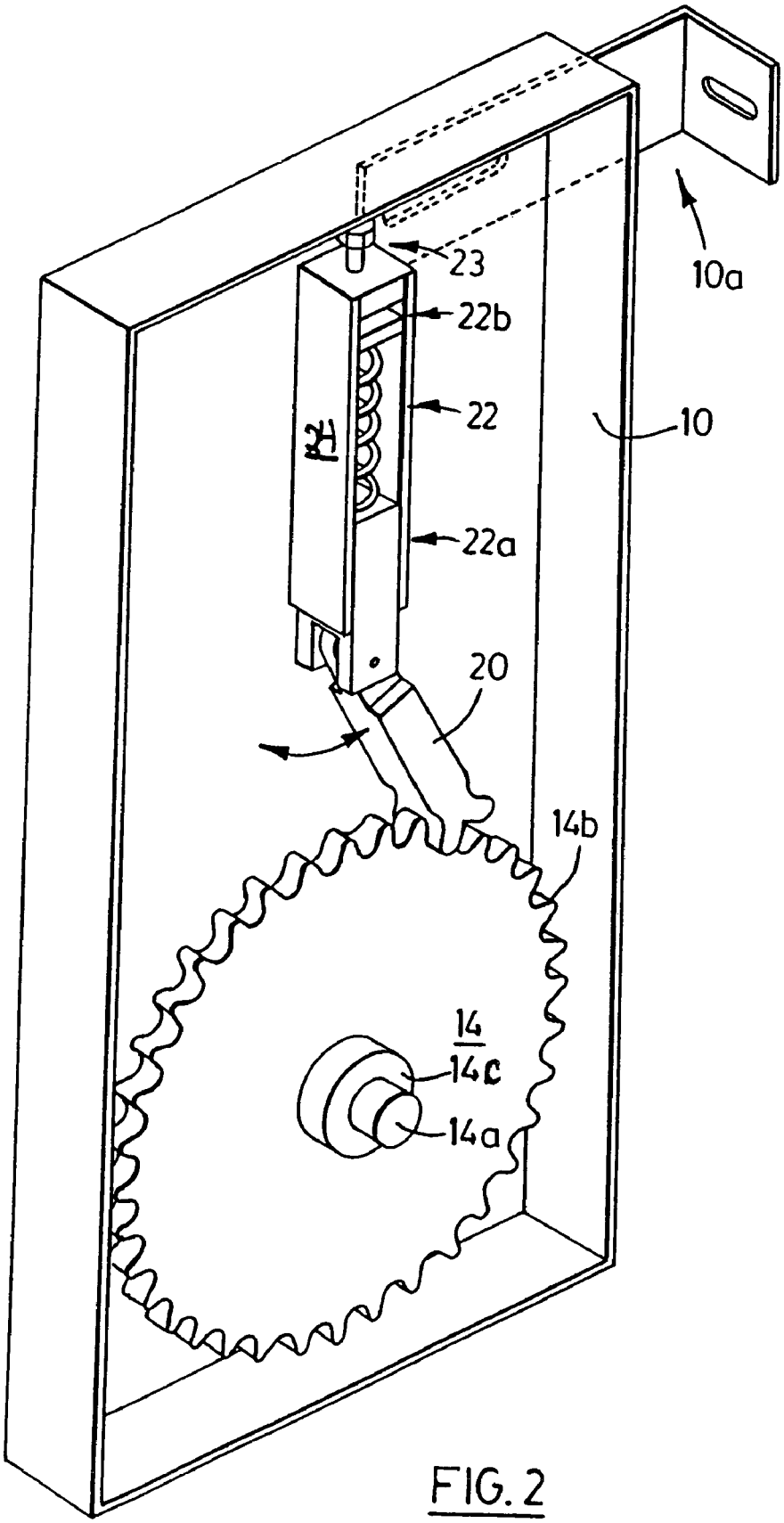
FIG. 2 is a perspective part-sectional view of the device seen in a direction generally perpendicular to the plane of the door.
Figure 2A:
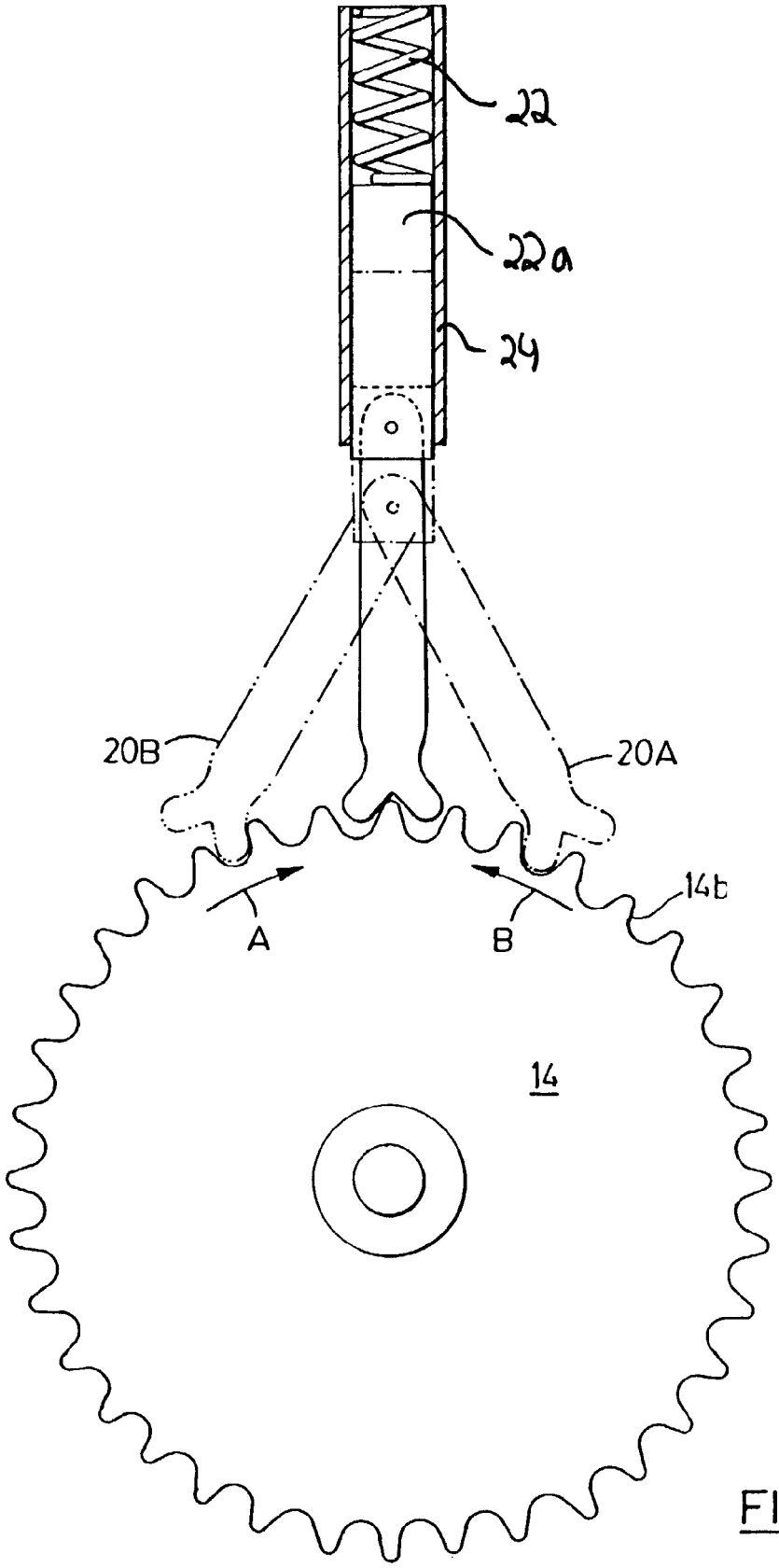
FIG. 2A is a schematic detail illustration of the interaction between the compression spring means and the pendulum arm/ratchet locking means in operation of the invention.

As best seen with reference to FIGS. 2A and 3, raising the door manually will rotate sprocket wheel 14 in one rotational direction, here illustrated by arrow A, so that the engagement of one projection from the bifurcation of the head 20*a* of the sprocket requires arm 20 to be pivoted about a pivot point 20*b* in its tail end, compressing spring 22 between pendulum arm 22*a* and spring block 22*b* through a central position of maximum spring compression, then turning the ratchet arm 20 to its other extreme orientation illustrated at 20A.

At orientation 20A, a projection formed by the bifurcation of the head of the ratchet arm engages sufficiently with one of the sprocket teeth 14*b*, to hold the door at its position under a preset tension of compression spring 22, selected to be great enough to resist the torque applied to sprocket wheel 14 by the reason of weight of the door, but can be easily overcome by manual force applied to the door to raise or lower it to another position.

Similarly, lowering the door manually will rotate sprocket wheel 14 in the other rotational direction, illustrated by arrow B, from position A, through a central compressive position, to a final orientation 20B. With the door released at that point, the second projection formed by the bifurcation of the head of ratchet arm 20 engages with sprocket wheel 14 to resist drifting of the door by opposing the torque which the free weight of the door applies to sprocket wheel 14.

From this description it will be seen that the positional control device of the present invention prevents accidental drifting of an overhead door upwardly or downwardly from any position along its full path of travel. It allows the door to be manually moved to a different elevation without the need to "unlock" the door from its original position, since the added force applied by the person raising or lowering the door suffices to overcome the spring-biased engagement of the ratchet head with the sprocket teeth.

The invention has been described with reference to a particular preferred embodiment, but will be understood by those of ordinary skill in the art that modifications may be made to the structure disclosed herein without departing from the spirit and scope of the invention, defined by the attached claims.

I claim:

1. A positional control device for use with a sectional door counterbalance system having an elongate spring shaft which rotates axially with the raising or lowering of the door comprising:

a toothed sprocket wheel;

means for coupling said sprocket wheel to said spring shaft for co-axial rotation therewith;

a ratchet arm having a front end and a rear end, said front end being bifurcated into a symmetrical pair of convex projections, each projection being adapted for engagement between a pair of adjacent teeth of said sprocket wheel;

a compression member, the rear end of said ratchet arm being connected toward the rear end thereof to said compression member at a pivot point for pivotal motion of the ratchet arm within the plane of said sprocket wheel about said pivot point; and adjustable biasing means operatively connected to said compression member to urge one of said projections into engagement with the teeth of the sprocket wheel, thereby exerting a braking force sufficient to prevent rotation of the sprocket wheel against the tendency of any sectional door to drift under its free weight, but permitting manually applied force to raise or lower the door from a stationary position.

2. A pivotal control device according to claim 1, wherein said biasing means is a spring.

3. A pivotal control device according to claim 2, further comprising an elongate housing fixedly mounted to a wall of the door opening, said housing including a slide channel to receive said compression member for linear reciprocating motion within said channel, said spring being contained within the channel and bearing against said compression member.

4. A positional control device according to claim 3, wherein said spring is a compression spring and said housing is provided with means for adjusting the compressive force exerted by the spring.

5. A positional control device according to claim 3, wherein said means for adjusting the compressive force of the spring comprises a spring block member within said channel and an adjusting screw therefor extending through said housing.

6. A positional control device according to claim 3, wherein said means for coupling said spring shaft to said sprocket wheel comprises a central drive shaft extending centrally through said sprocket wheel and a collar for connecting the ends of said spring shaft and said drive shaft in collinear connection.

7. A positional control device for use with a sectional door counterbalance system having an elongate spring shaft which rotates axially with the raising or lowering of the door comprising:

a toothed sprocket wheel;

means for coupling said sprocket wheel to said spring shaft for co-axial rotation therewith;

a ratchet arm having a front end and a rear end, said front end being bifurcated into a symmetrical pair of convex projections, each projection being adapted for engagement between a pair of adjacent teeth of said sprocket wheel;

a compression member, the rear end of said ratchet arm being connected toward the rear end thereof to said compression member for pivotal motion of the ratchet arm within the plane of said sprocket wheel;

adjustable biasing means comprising a spring operatively connected to said compression member to urge one of said projections into engagement with the teeth of the sprocket wheel, thereby exerting a braking force sufficient to prevent rotation of the sprocket wheel against the tendency of any sectional door to drift under its free weight, but permitting manually applied force to raise or lower the door from a stationary position; and an elongate housing fixedly mounted to a wall of the door opening, said housing including a slide channel to receive said compression member for linear reciprocating motion within said channel, said spring being contained within the channel and bearing against said compression member.

8. A positional control device according to claim 7, wherein said spring comprises a compression spring and said housing is provided with means for adjusting the compressive force exerted by the spring.

9. A positional control device according to claim 7, wherein said means for adjusting the compressive force of the spring comprises a spring block member within said channel and an adjusting screw therefor extending through said housing.

10. A positional control device according to claim 7, wherein said means for coupling said spring shaft to said sprocket wheel comprises a central drive shaft extending centrally through said sprocket wheel and a collar for connecting the ends of said spring shaft and said drive shaft in collinear connection.

* * * * *